US008360041B2

(12) United States Patent
Strother

(10) Patent No.: US 8,360,041 B2
(45) **Date of Patent: *Jan. 29, 2013**

(54) TWO-TRACK SYSTEM FOR DUAL CAM COMPOUND BOW

(75) Inventor: Kevin D. Strother, Moses Lake, WA (US)

(73) Assignee: Perfect Form Manufacturing, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/181,220

(22) Filed: Jul. 12, 2011

(65) Prior Publication Data

US 2011/0271939 A1 Nov. 10, 2011

Related U.S. Application Data

(63) Continuation of application No. 12/330,871, filed on Dec. 9, 2008, now Pat. No. 8,006,679.

(60) Provisional application No. 61/062,380, filed on Jan. 25, 2008.

(51) Int. Cl.
*F41B 5/10* (2006.01)

(52) U.S. Cl. ..... 124/25.6; 124/900

(58) Field of Classification Search ..... 124/25.6, 124/900

See application file for complete search history.

(56) References Cited

U.S. PATENT DOCUMENTS

| | | | | |
|---|---|---|---|---|
| 3,990,425 | A | 11/1976 | Ketchum | |
| 4,060,066 | A | 11/1977 | Kudlacek | |
| 4,368,718 | A | 1/1983 | Simonds | |
| 4,401,097 | A | 8/1983 | Simonds | |
| 4,438,753 | A | 3/1984 | Simonds | |
| 4,774,927 | A | 10/1988 | Larson | |
| 5,040,520 | A | 8/1991 | Nurney | |
| 5,975,067 | A | 11/1999 | Strother | |
| 6,237,582 | B1 | 5/2001 | McPherson | |
| 6,247,466 | B1 | 6/2001 | McPherson | |
| RE37,544 | E | 2/2002 | Darlington | |
| 6,446,619 | B1 | 9/2002 | McPherson | |
| 6,718,963 | B1 | 4/2004 | Wheeler | |
| 6,990,970 | B1 | 1/2006 | Darlington | |
| 7,082,937 | B1 | 8/2006 | Land | |
| 7,305,979 | B1 | 12/2007 | Yehle | |
| 8,006,679 | B2 * | 8/2011 | Strother | 124/25.6 |
| 2009/0255520 | A1 | 10/2009 | Strother | |
| 2009/0320816 | A1 | 12/2009 | Strother | |
| 2010/0051005 | A1 | 3/2010 | Wilson | |

* cited by examiner

*Primary Examiner* — John Ricci
(74) *Attorney, Agent, or Firm* — Hiscock & Barclay, LLP

(57) ABSTRACT

The present invention comprises a two-track cam assembly wherein the cam assembly has a bowstring component for housing the bowstring and a power cable component that allows for the take up and let out of the power cable on opposing ends of the power cable component, effectively creating a two-track cam assembly. The efficiency rating of the device achieves 95.8%. The cam assembly can come in a unitary or modular form and further each component (i.e. the bowstring or power cable component) can be in a circular or non-circular form.

20 Claims, 11 Drawing Sheets

TWO-TRACK SYSTEM FOR DUAL CAM COMPOUND BOW

CROSS-REFERENCE TO RELATED APPLICATIONS

This is a continuation of U.S. patent application Ser. No. 12/330,871 filed Dec. 9, 2008, which claims the priority date of U.S. Provisional Application Ser. No. 61/062,380, entitled "COMPOUND ARCHERY BOW" filed Jan. 25, 2008.

FIELD OF THE INVENTION

This invention relates to compound bows, and more specifically, it relates to a two-track system for bow strings and power cables of the compound bow.

BACKGROUND OF THE INVENTION

Cams have been used on compound bows for some time. Compound bows have opposing limbs extending from a handle portion which house the cam assemblies. Typically, the cam assemblies are rotatably mounted on an axel which is then mounted on a limbs of bow. The compound bows have a bow string attached to the cam which sits in a track and also, generally, two power cables that each sit in a track on a separate component on the cam, and either anchored to the cam or a limb/axel. When a bowstring is pulled to full draw position, the cam is rotated and the power cables are "taken up" on their respective ends to increase energy stored in the bow for later transfer, with the opposing ends "let out" to provide some give in the power cable.

Cam assemblies are designed to yield efficient energy transfer from the bow to the arrow. Some assemblies seek to achieve a decrease in draw force closer to full draw and increase energy stored by the bow at full draw for a given amount of rotation of the cam assembly.

There exists a number of U.S. patents directed to compound bows, including U.S. Pat. No. 7,305,979 issued to Craig Yehle on Dec. 11, 2007. The Yehle patent discloses a cam assembly having a journal for letting out a draw cable causing the cam to rotate and two other journals for take-up mechanism and a let-out mechanism for the two power cables. The Yehle patent requires that the power cables and draw string each sit in a different components and tracks for the take up and let out mechanism to work and to have the efficiencies described therein.

Therefore, a compound bow having a mechanism with fewer tracks is desired because of the advantage in assembly in manufacturing and to increase efficiency in the transfer of energy to propel bows.

Further, an adjustable or modular take-up/let-out mechanism is desired to account for different size draw lengths or other specifications required by the user.

SUMMARY OF THE INVENTION

The invention comprises, in one form thereof, a cam assembly comprising bowstring cam component having a track for receiving a bowstring; and a power cable cam component having a take up portion and a let out portion, wherein the take up and let out portion have a track for receiving a power cable.

More particularly, the invention includes a compound bow comprising a handle portion; a limb portion; at least two cam assemblies, each comprising a bowstring cam component having a track for receiving a bowstring; and a power cable cam component having a take up portion and a let out portion, wherein the take up and let out portion have a track for receiving a power cable, a draw stop pin, a take up terminating post, and a let out terminating post; an axel; at least two power cables; and a bowstring.

The cam assembly has a two track system wherein the power cables utilize a track or opposing tracks made on the power cable component of the cam assembly. Another track is formed on the bowstring component of the cam assembly in which the bowstring lies.

An advantage of the present invention is that the device has high efficiency in transferring energy stored in the limbs during the draw cycle to the arrow or other projectile of the device.

A further advantage of the present invention is that it requires less component parts for cam assembly which is highly desirable in the art.

An even further advantage of the present invention is that the cam assembly allows for a modular format which allows the user to change minor components to change parameters of the device (e.g. draw length) without having to change the entire cam assembly or bow.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate a few embodiments of the invention but should not be construed as limiting the scope of the invention in any manner.

DETAILED DESCRIPTION

Figure 1:
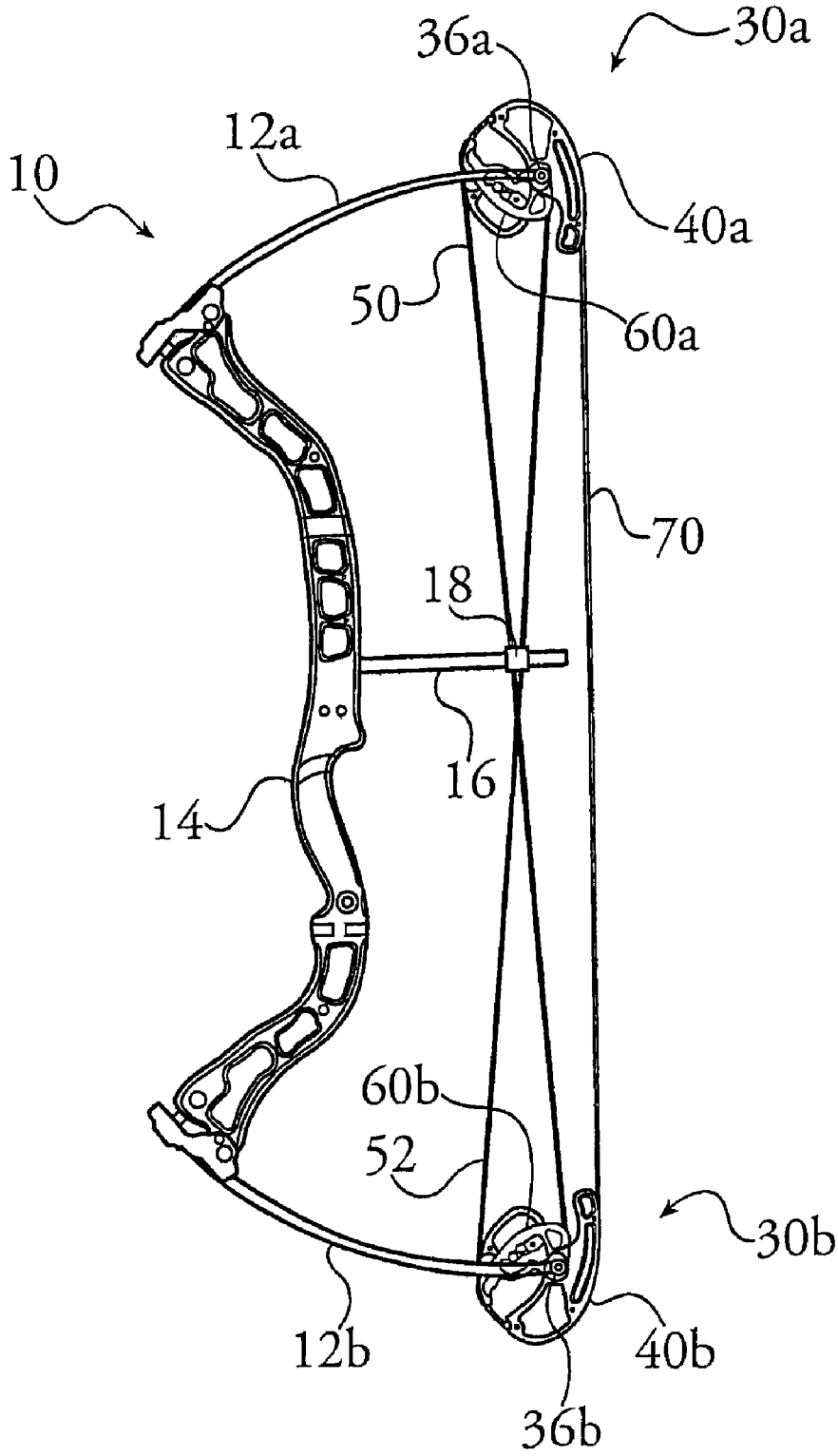
FIG. 1 is a side view of a dual cam compound bow embodying the present invention.

FIG. 1 shows a dual cam compound bow 10 of the present invention. The bow 10 has a frame, which includes bow limbs 12*a,b* extending from handle 14. Extending from the handle is cable guard 16 and a cable slide 18 through which the power cables 50 and 52 are placed. The bowstring 70 and power cables 50, 52 are attached to the bow 10 at the cam assemblies

30*a,b*, which further is placed on the limbs via axel 36*a,b*. The cams 30*a,b* are shown in greater detail in the following figures.

The cams 30*a,b* have bowstring assemblies 40*a,b*, each having a single track for the bowstring 70 with each end of the bowstring 70 being attached to the cams 30*a,b* at a terminating post (not shown). Further, the each of the cams 30*a,b* have terminating posts 80,82 for each of the ends of the respective power cables 50, 52, and which will be described in more detail herein. Further, each cam assembly 30*a,b* has a power cable assembly 60*a,b* having either a single track or groove around perimeter of the assembly 60*a,b* for receiving or retaining the power cables. Alternatively, the power cable assembly 60*a,b* can have the tracks or grooves on the portions of the assembly receiving the cable instead of a unitary track around the perimeter. The power cable assembly 60*a,b* has a take up portion 62*a,b* and a let out portion 64*a,b* for managing the take up and let out of the power cables through a single track.

Figure 2:
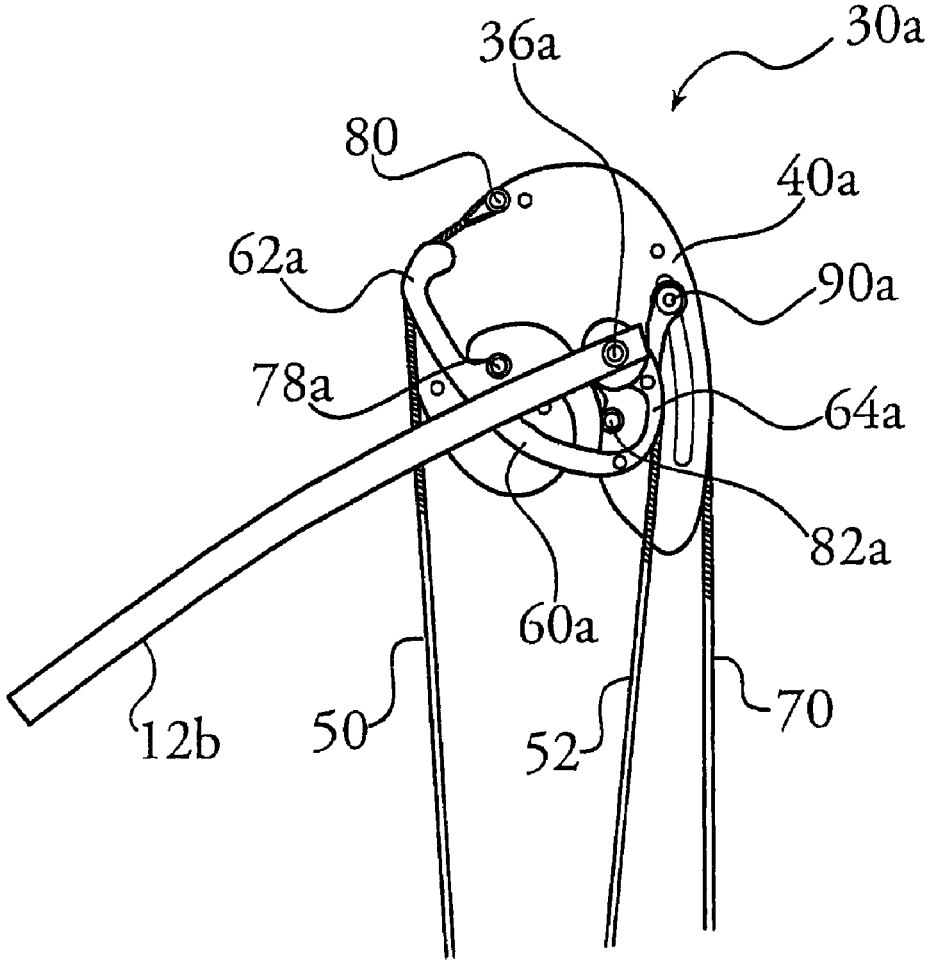
FIG. 2 is a side view of the top cam assembly in a first embodiment of the present invention.

FIG. 2 shows a side view of the top cam assembly 30*a*. FIG. 2 shows one embodiment of the cam 30*a* in non-circular shape. The bowstring 70 is in line with the track in the bowstring assembly 40*a* and attached with a terminating post (not shown). The power cable assembly 60*a* has a take up portion 62*a* and a let out portion 64*a*, and can either be a unitary piece or be modular. For instance as shown in FIG. 2, the power cable assembly 60*a* has a modular unit for the let out portion 64*a*, which allows manufacturers to make a single cam assembly with one small piece that can account for varying sizes and preferences by the user. Specifically, this versatility is important because each hunter or archer has different specifications (e.g. draw length) which can be accounted for by having a modular portion to the cam assembly 30*a*, and in this case is the let out portion 64*a*. The power cable 52, in FIG. 2, is attached to terminating post 82*a* and wraps around the let out portion 64*a* and therefore feeds power cable 52 out when the bow is in full draw. On the opposing side of power cable assembly 60*a* is power cable 50, which sits on the take up portion 62*a* of the assembly 60*a*. Power cable 50 is attached at terminating post 80*a*, and is taken up when the bow is in full draw by the take up portion 62*a*. The power cable assembly 60*a* is attached to the bowstring assembly 30*a* by a fastening mechanism, but it will be well recognized the power cable assembly 60*a* can be attached to the bowstring assembly 40*a* by any means or, if desired, manufactured as a single piece with the bowstring assembly 40*a* to make-up top cam assembly 30*a*. As shown, the power cable assembly 60*a* is attached to the bowstring assembly 40*a* by a fastener 78*a*. The cam assembly 30*a* is attached to the limb 12*a* by axel 36*a*. Last the take power cable assembly 60*a*, either in a unitary form or modular form, may optionally have draw stop pin 90*a* attached to stop the draw cycle of the bow. The draw stop pin 90*a*, however, does not have to be attached to the power cable assembly 60*a* in order to function on the cam assembly 30*a*.

Figure 3:
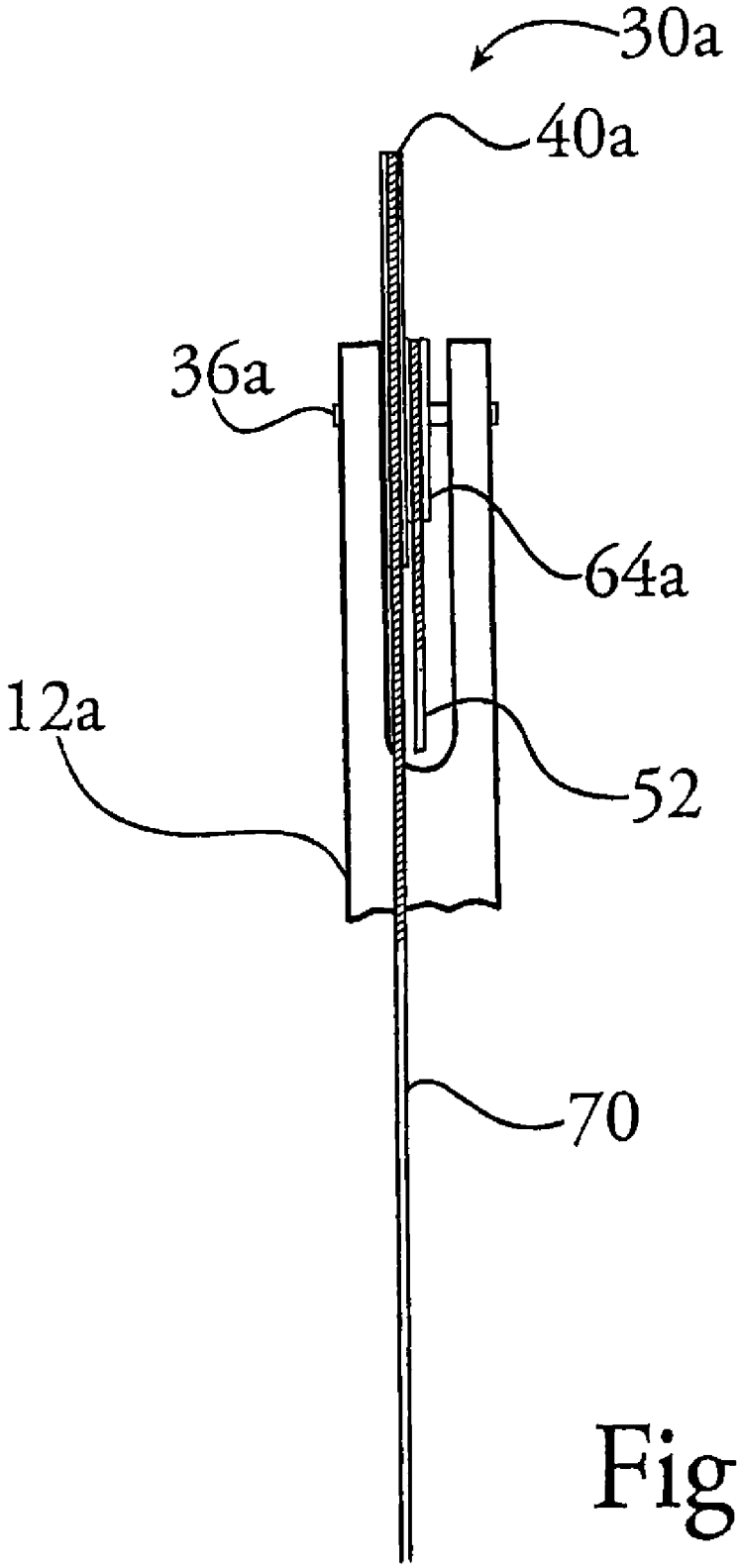
FIG. 3 is a rearview of the top cam assembly in a first embodiment of the present invention.

FIG. 3 shows the rearview of the top cam assembly. As seen from this perspective, the cam assembly 30*a* has one track on the bowstring assembly 40*a* for the bowstring 70 and a second track for the power cables 52 and 50 (not shown) on same track but on opposing sides of the power cable assembly 60*a*. In FIG. 3, the let out portion 64*a* is visible with power cable 52 sitting in the track or groove. Axel 36*a* is inserted through the limb 12*a* and then the cam assembly 30*a* and then the other end of the limb 12*a*.

Figure 4:
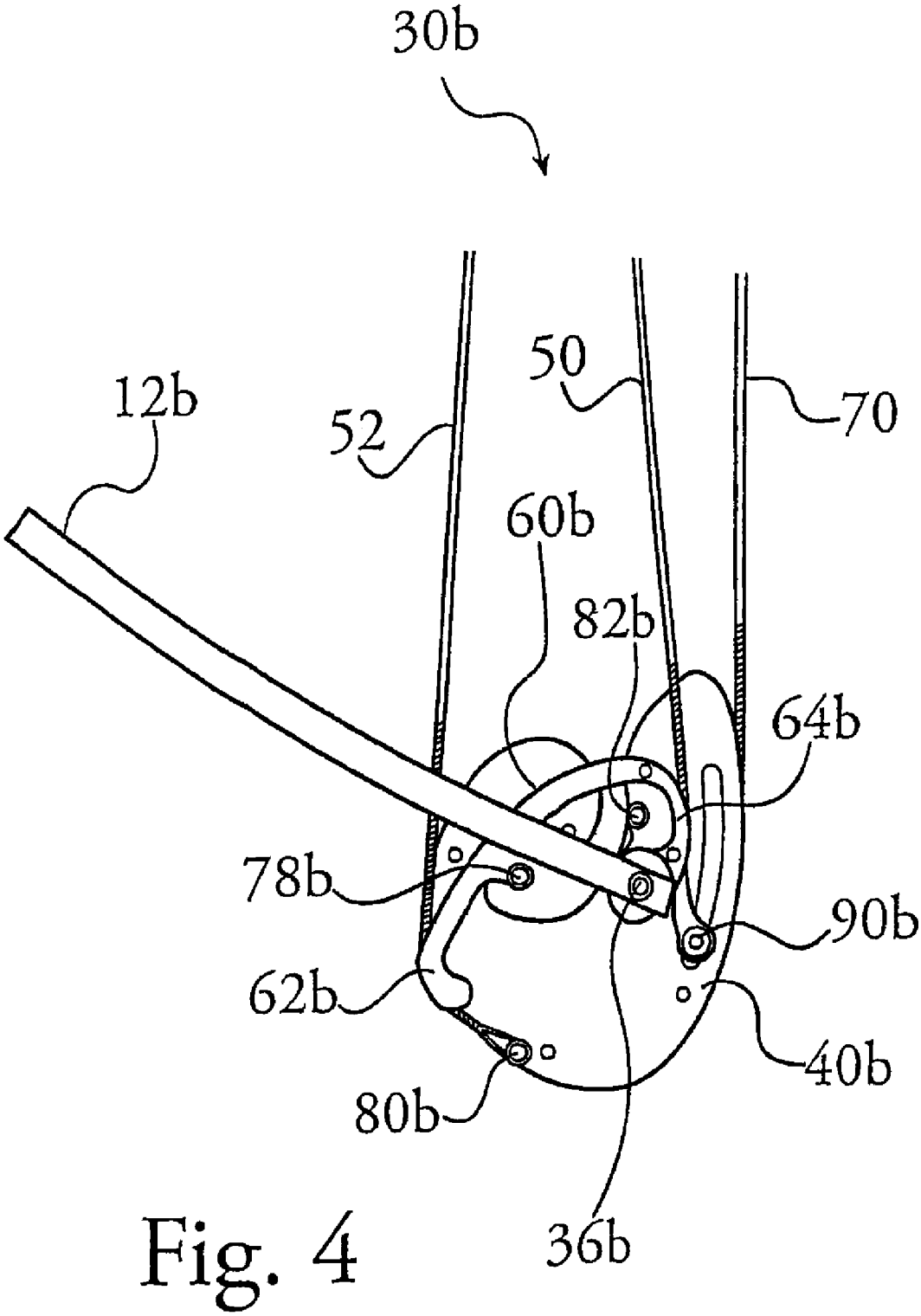
FIG. 4 is a side view of the bottom cam assembly in a first embodiment of the present invention.

FIG. 4 shows a side view of the bottom cam assembly 30*b*. FIG. 4 shows the bottom cam 30*b* in non-circular shape as well. The bowstring 70 is in bowstring assembly 40*b* and attached with a terminating post (not shown). The power cable assembly 60*b* has a take up portion 62*b* and a let out portion 64*b*, which can either be a unitary piece or as shown can have a modular unit. In FIG. 4, there is a modular assembly shown where the let up portion 64*b* can be changed in size and shape according to the user's specifications. The power cable 52, in FIG. 4, is attached to terminating post 80*b* and wraps around the take up portion 62*b* and therefore is taken up when the bow is in full draw. On the opposing side of power cable assembly 60*b* is power cable 50, which attaches to terminating post 82*b* and wraps around the let out portion 64*b*, and is let out when the bow is in full draw position. The power cam assembly 60*b* is attached to the bowstring assembly 30*b* by a fastening mechanism, the two assemblies can be attached by any means or if desired manufactured as a single piece. As shown, the power cable assembly 60*b* is attached to the bowstring assembly 40*b* by a fastener 78*b*. The cam assembly 30*b* is attached to the limb 12*b* by axel 36*b*. Last the power cable assembly 60*b*, either in a unitary or modular form, may optionally have draw stop pin 90*b* attached to stop the draw cycle of the bow.

Figure 5:
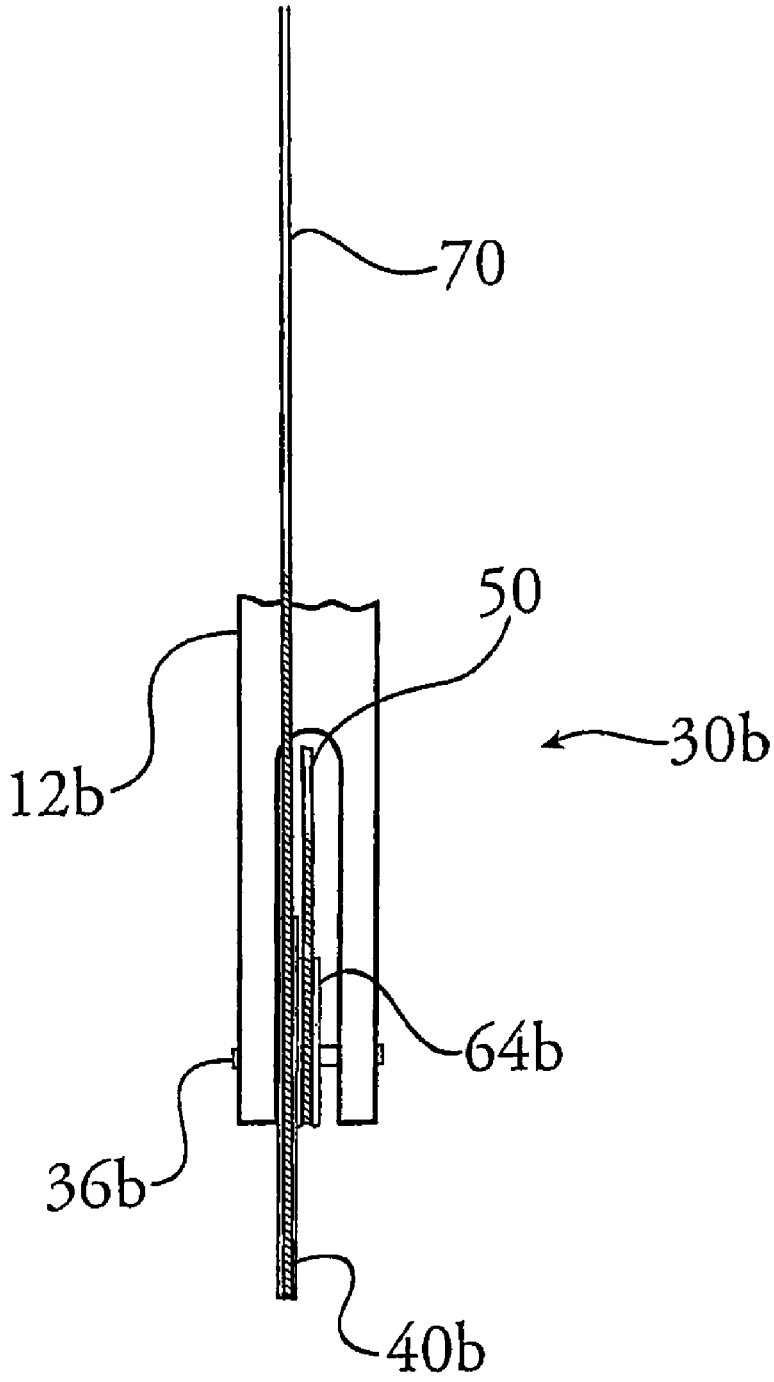
FIG. 5 is a rearview of the bottom cam assembly in a first embodiment of the present invention.

FIG. 5 shows the rearview of the bottom cam assembly 30*b*. As seen from this perspective, the cam assembly 30*b* has a bowstring assembly 40*b* for the bowstring 70, and a power cable assembly 60*b* for both power cables 50,52. In FIG. 5, power cable 50 is visible because it is sitting on the let out portion 64*b* of the power cable assembly 60*b*. Axel 36*b* allows bottom cam assembly 30*b* to rotate when the drawstring is pulled, and holds bottom cam assembly 30*b* in limb 12*b*.

Figure 6:
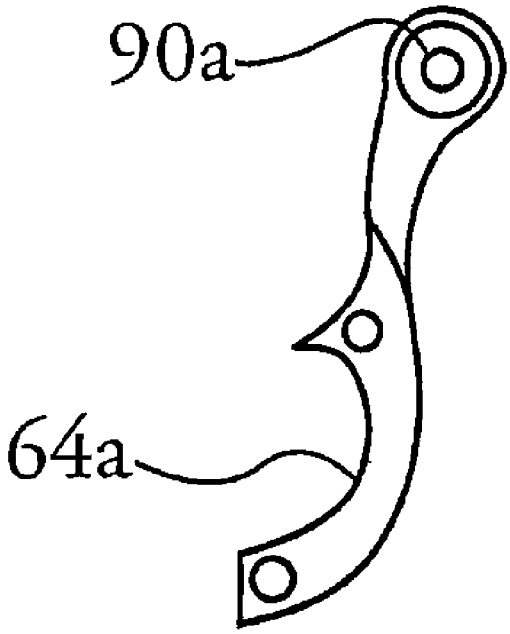
FIGS. 6 and 7 show the modular form of the let out portion 64*a,b* with the draw stop pin 90*a,b* attached thereto.
Figure 7:
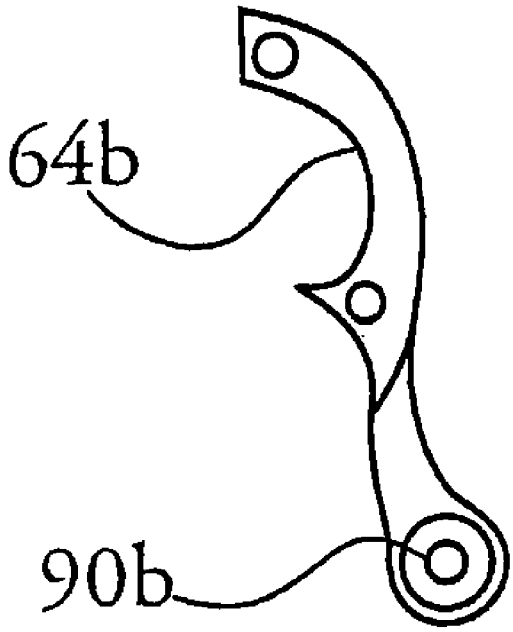

FIGS. 6 and 7 show the modular form of the let out portion 64*a,b* and draw stop pin 90*a,b* for the cam assemblies 30*a,b*. The let out portion 64*a,b* and draw stop pins 90*a,b* can be attached in any number of ways or can be further manufactured as a unitary piece. Further, as described above, let out portion 64*a,b* can be manufactured as a single part of power cable assembly 60*a,b*. Therefore, though the modular form is more desirable to personalize the parameters of the device size (e.g. draw length), the cam assembly could be manufactured as a single unit or in varying degrees of pieces.

Figure 8:
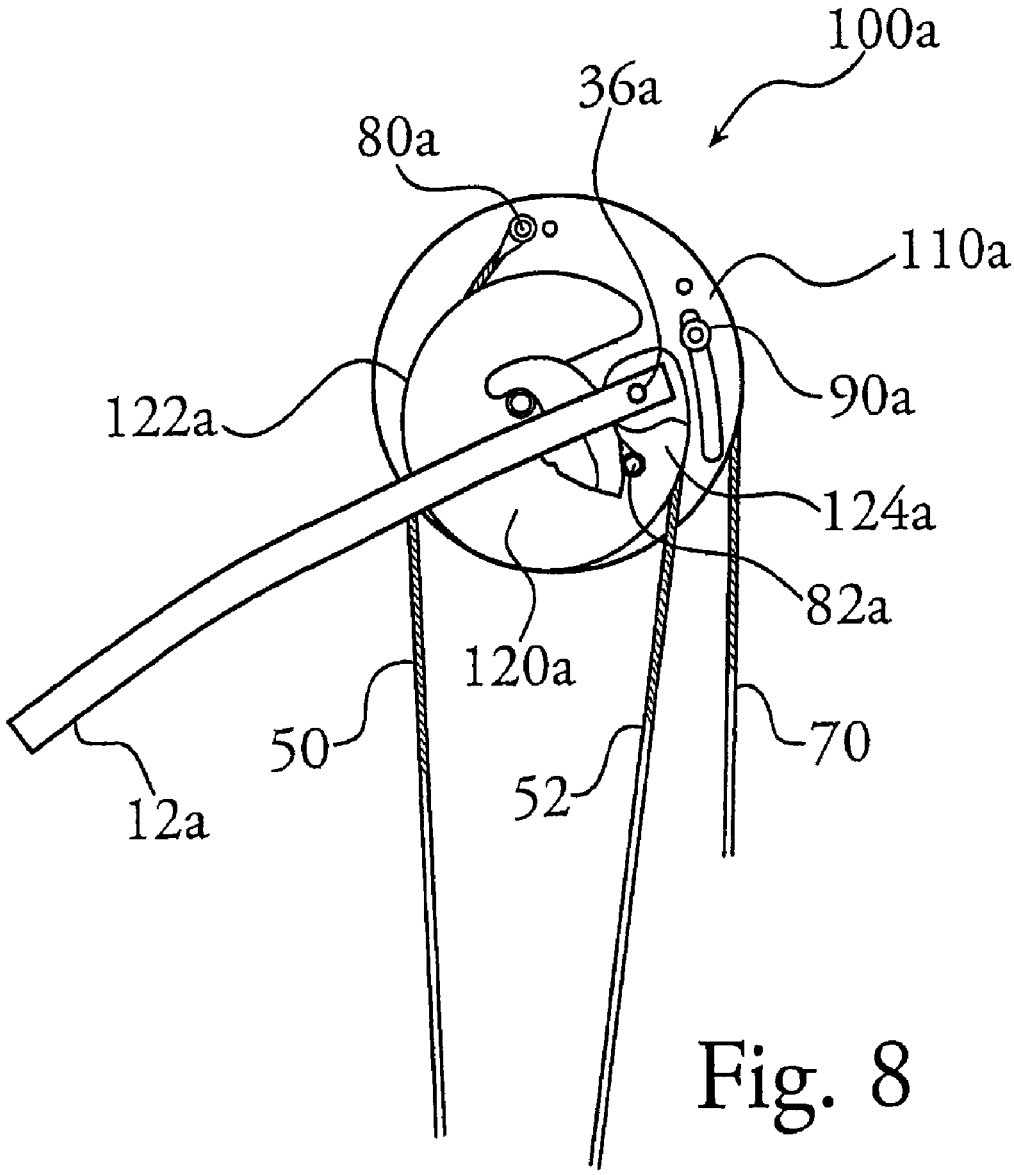
FIG. 8 is a side view of the top cam assembly in a second embodiment of the present invention.
Figure 9:
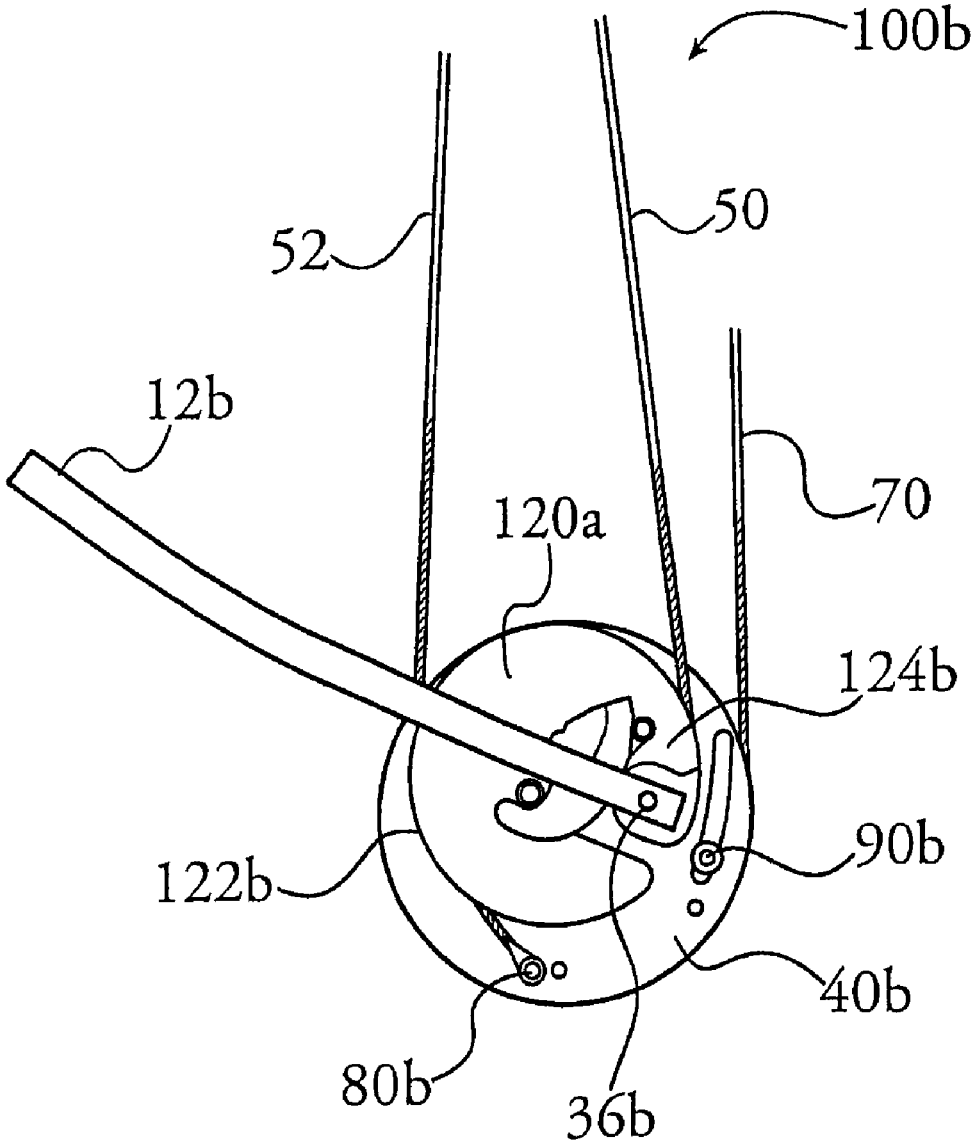
FIG. 9 is a side view of the bottom cam assembly in a second embodiment of the present invention.

FIGS. 8 and 9 show a side view of a second embodiment of the present invention 100*a,b*. FIG. 8 shows the top cam assembly 100*a* is in a circular shape. In particular, the power cable assembly 120*a* is shown as being in a unitary form, having the take up portion 122*a* and let out portion 124*a*. The draw stop pin 90*a* is not attached to the power cable assembly 120*a*, though if preferred the assembly 120*a* could be attached to the pin 90*a*. Further the bowstring assembly 110*a* is also in a circular or disc shape with power cable assembly 120*a* attached thereto. FIG. 9 exemplifies the bottom cam assembly 100*b* for the second embodiment, which is in a circular or disc shape. Generally the other components of the cam assemblies 100*a,b* are similar to those shown in the first embodiment.

Figure 10:
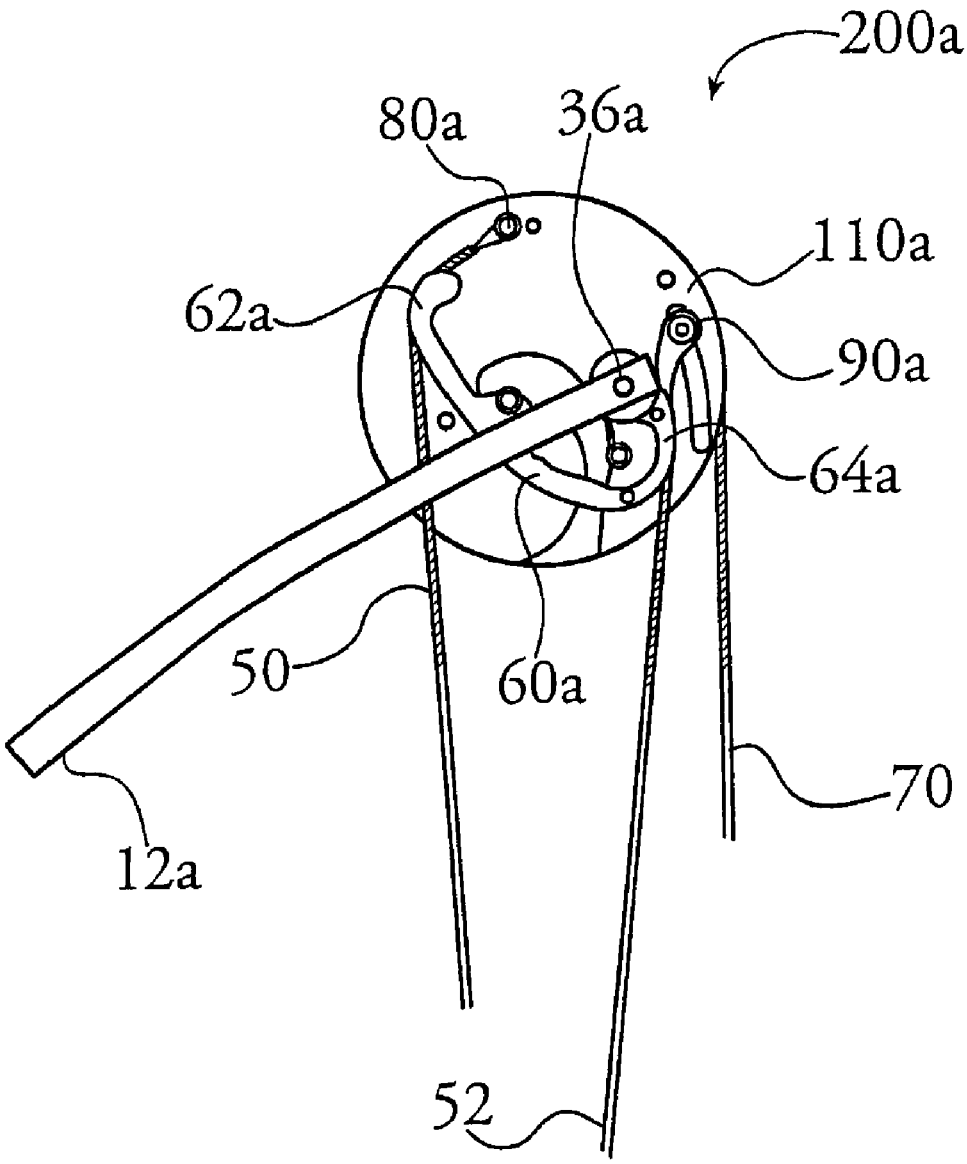
FIG. 10 is a side view of the top cam assembly in a third embodiment of the present invention.
Figure 11:
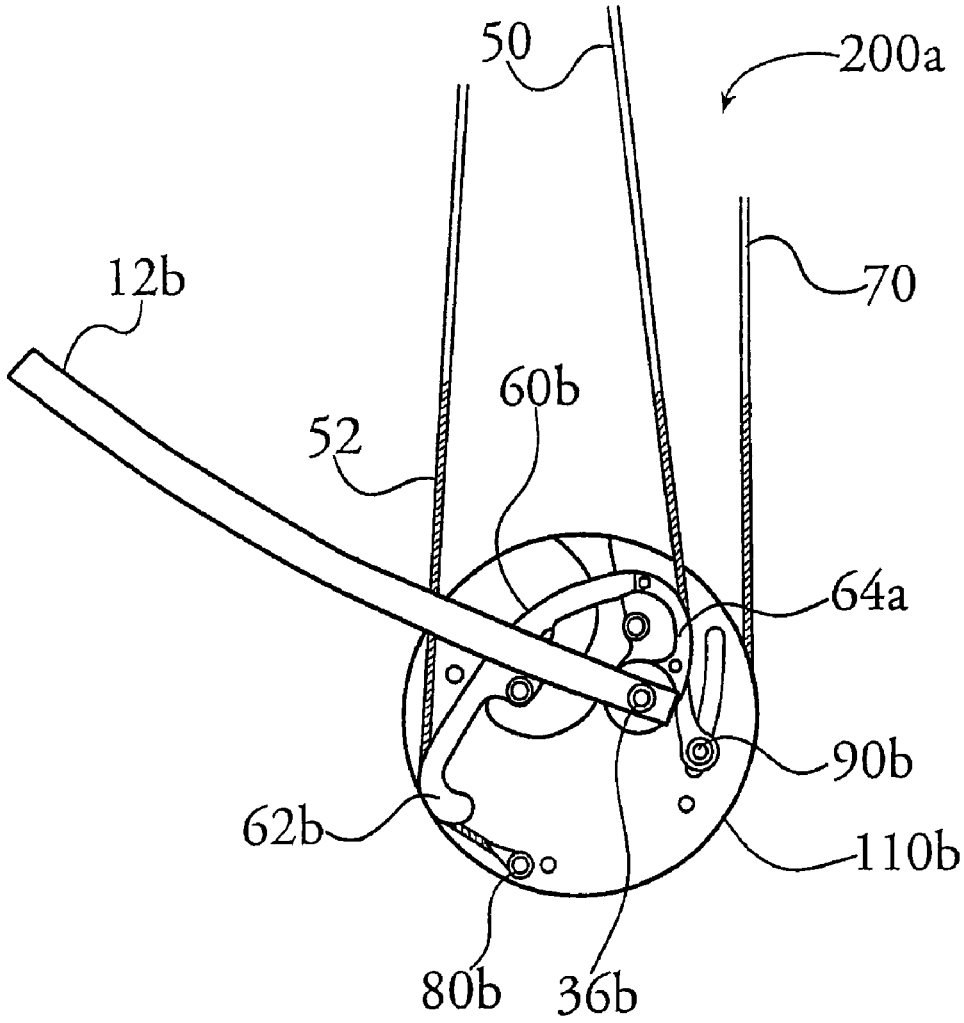
FIG. 11 is a side view of the bottom cam assembly in a third embodiment of the present invention.

FIGS. 10 and 11 show a third embodiment of the present invention, wherein the cam assembly 200*a,b* have a circular portion for the bowstring track 110*a,b* and a non-circular power cable assembly 60*a,b*. It will be understood that other embodiments could include a non-circular portion for the bowstring assembly and a circular power cable assembly and, again, can be either modular or unitary form. Further other geometrical shapes, such as ovular, may be used in varying forms for either the bowstring or power cable assembly.

Figure 12:
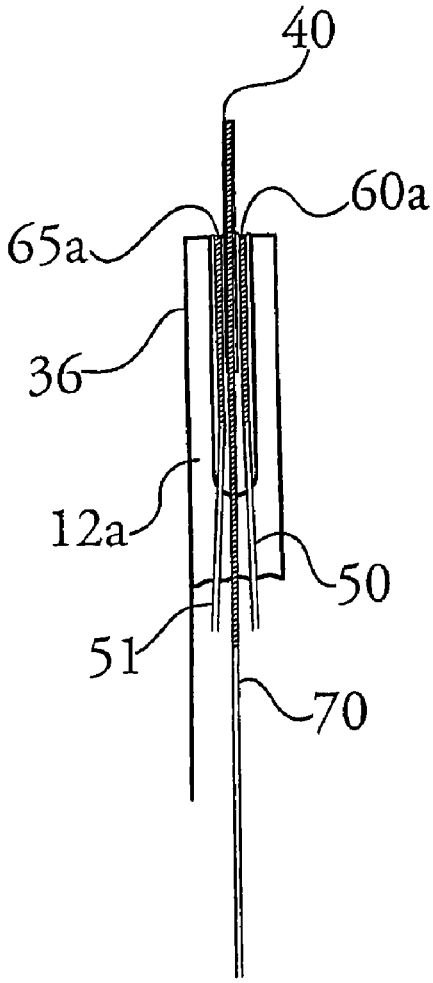
FIG. 12 is a rearview of the top cam assembly in a fourth embodiment of the present invention.
Figure 13:
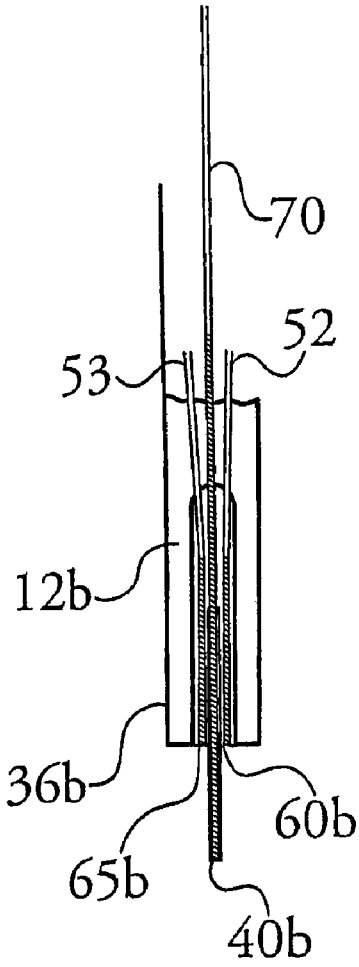
FIG. 13 is a rearview of the bottom cam assembly in a first embodiment of the present invention.

Still another embodiment could include a three track system, as shown in the rearview perspectives of FIGS. 12 and 13. The three track system would be used where there are four power cables. This type of embodiment would include two power cable assemblies as described above, both of which would be attached to the bowstring assembly.

In use, using the first embodiments as an exemplar and in reference to FIGS. 1-3, the bowstring 70 is pulled rearward toward the hunter or archer. The tension by the bowstring forces the cam assemblies 30*a,b* to rotate rearward. Focusing on FIG. 1, the power cable assembly 60*a* on top cam assembly 30*a* is moved upward as the entire cam 30*a* is moved rearward. The terminating post 80, with power cable 50 attached, moves upward, and therefore causes take up of power cable 50. On the bottom cam assembly 30*b* the cam 30*b* is also moved rearwardly. The positioning of the power cable assembly 60 and power cable 50 causes power cable 50 to be let out on the bottom cam assembly 30*a*. The same is true in the opposite manner for power cable 52 (i.e. power cable 52 is taken up) on the cam assemblies 30*a,b*. Accordingly energy is stored in the limbs of the device and transferred to the arrow or other projectile placed in the compound bow in a highly efficient manner with little shock to the user.

Though the compound bow embodying the invention may have differing specifications, the bow may have a brace height of about eight (8) inches and axel-to-axel length of about thirty-two and half (32½) inches. The draw length can range from twenty-seven (27) to thirty (30) inches and a draw weight between sixty (60) to eighty (80) inches.

It should be particularly noted that dual track cam disclosed in this invention has a highly efficient and powerful performance. With respect to speed, the following performance results were noted in a twenty-nine (29") inch draw cycle, sixty pound (60 lbs.) draw weight compound bow, in testing completed by Archery Evolution:

| Arrow (Grains) | 300 | 360 | 420 | 540 |
|---|---|---|---|---|
| Speed (ft./sec.) | 307.3 | 283.5 | 264.2 | 235.4 |
| Kinetic Energy (ft. lbs.) | 62.9 | 64.2 | 65.1 | 66.4 |
| Momentum | 13.2 | 14.6 | 15.9 | 18.2 |
| Dynamic Efficiency | 83.7% | 85.5% | 86.7% | 88.5% |
| Noise Output (dBA) | 88.7 | 84.1 | 85.5 | 87.1 |
| Total Vibration (G) | 222.8 | 234.4 | 228.7 | 188.6 |

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. A compound bow comprising:

a handle portion;

an upper limb portion having at least one upper cam assembly rotatably mounted thereon;

a lower limb portion having at least one lower cam assembly rotatably mounted thereon said upper cam assembly comprising:

a bowstring cam component having a track for receiving a bowstring and a slotted opening;

a power cable cam component having a take up portion and a let out portion; said take up portion having a track for receiving a power cable; said let out portion having a track for receiving a power cable; the tracks for the take up portion and let out portion being substantially coplanar;

a draw stop pin attached to said bowstring cam component while being inserted through said slotted opening; and said lower cam assembly comprising:

a bowstring cam component having a track for receiving a bowstring;

a power cable cam component having a take up portion and a let out portion; said take up portion having a track for receiving a power cable; said let out portion having a track for receiving a power cable; the tracks for the take up portion and let out portion being substantially coplanar.

2. The compound bow of claim 1 further comprising:

a first power cable having a first and second end;

a second power cable having a first and second end; and a bowstring;

wherein said first power cable is anchored to said upper cam assembly with a portion adjacent to the first end of said first power cable received in the track of said take up portion of said power cable cam component on said upper cam assembly and the second end is anchored to said lower cam assembly with a portion adjacent to the second end of said first power cable received in the track of said let out portion of said power cable cam component on the lower cam assembly;

wherein said second power cable is anchored to said upper cam assembly with a portion adjacent to the first end of said second power cable received in the track of said let out portion of said power cable cam component on said upper cam assembly and the second end is anchored to said lower cam assembly with a portion adjacent to the second end of said second power cable received in the track of said take up portion of said power cable cam component on the lower cam assembly;

such that the first end of said first power cable and the first end of said second power cable are coplanar; and the second end of said first power cable and the second end of said second power cable are coplanar.

3. The compound bow of claim 1 wherein a location of said draw stop pin can be adjusted within said slotted opening.

4. The compound bow of claim 3 wherein said let out portion is attached to said draw stop pin.

5. The compound bow of claim 4 wherein a position of said let out portion is adjustable by adjusting a location of said draw stop pin within said slotted opening.

6. The compound bow of claim 1 wherein the tracks on said take up portion and said let out portion of said power cable cam component of said upper cam assembly are a continuous track around at least a portion on the periphery of said power cable cam assembly.

7. The compound bow of claim 6 wherein the tracks on said take up portion and said let out portion of said power cable cam component of said lower cam assembly are a continuous track around at least a portion on the periphery of said power cable cam assembly.

8. The compound bow of claim 1 wherein the tracks on said take up portion and said let out portion of the power cable cam component are distinct, non-continuous tracks on the periphery of said power cable cam assembly.

9. The compound bow of claim 1 wherein said power cable cam component of said upper cam assembly further comprises a modular unit that is sized and shaped to change draw parameters of said compound bow, and is designed to be interchanged with another modular let out portion being of a different size and shape to change said draw parameters of said compound bow.

10. The compound bow of claim 1 wherein said power cable cam component of said lower cam assembly further comprises a modular unit that is sized and shaped to change draw parameters of said compound bow, and is designed to be interchanged with another modular let out portion being of a different size and shape to change said draw parameters of said compound bow.

11. The compound bow of claim 1 wherein a location of said draw stop pin can be adjusted within said slotted opening.

12. The compound bow of claim 1 wherein said power cable cam component of said lower cam assembly further comprises a modular unit that is sized and shaped to change draw parameters of said compound bow, and is designed to be interchanged with another modular let out portion being of a different size and shape to change said draw parameters of said compound bow.

13. A compound bow comprising:

a handle portion;

an upper limb portion having at least one upper cam assembly rotatably mounted thereon;

a lower limb portion having at least one lower cam assembly rotatably mounted thereon said upper cam assembly comprising:

a bowstring cam component having a track for receiving a bowstring;

a power cable cam component having a take up portion and a let out portion; said take up portion having a track for receiving a power cable; said let out portion having a track for receiving a power cable; the tracks for the take up portion and let out portion being substantially coplanar; and said lower cam assembly comprising:

a bowstring cam component having a track for receiving a bowstring and a slotted opening;

a power cable cam component having a take up portion and a let out portion; said take up portion having a track for receiving a power cable; said let out portion having a track for receiving a power cable; the tracks for the take up portion and let out portion being substantially coplanar;

a draw stop pin attached to said bowstring cam component while being inserted through said slotted opening.

14. The compound bow of claim 13 further comprising:

a first power cable having a first and second end;

a second power cable having a first and second end; and a bowstring;

wherein said first power cable is anchored to said upper cam assembly with a portion adjacent to the first end of said first power cable received in the track of said take up portion of said power cable cam component on said upper cam assembly and the second end is anchored to said lower cam assembly with a portion adjacent to the second end of said first power cable received in the track of said let out portion of said power cable cam component on the lower cam assembly;

wherein said second power cable is anchored to said upper cam assembly with a portion adjacent to the first end of said second power cable received in the track of said let out portion of said power cable cam component on said upper cam assembly and the second end is anchored to said lower cam assembly with a portion adjacent to the second end of said second power cable received in the track of said take up portion of said power cable cam component on the lower cam assembly;

such that the first end of said first power cable and the first end of said second power cable are coplanar; and the second end of said first power cable and the second end of said second power cable are coplanar.

15. A compound bow comprising:

a handle portion;

a first power cable having a first and second end;

a second power cable having a first and second end;

a bowstring;

an first limb portion having a first cam assembly rotatably mounted thereon;

a second limb portion having a second cam assembly rotatably mounted thereon;

said first cam assembly comprising:

a bowstring cam component having a track for receiving a bowstring;

a power cable cam component having a take up portion and a let out portion;

a take up terminating post; and a let out terminating post;

said take up portion having a track for receiving a power cable; said let out portion having a track for receiving a power cable; the tracks for the take up portion and let out portion being substantially coplanar;

said second cam assembly comprises:

a bowstring cam component having a track for receiving a bowstring and a slotted opening;

a power cable cam component having a take up portion and a let out portion;

a take up terminating post;

a let out terminating post; and a draw stop pin attached to said bowstring cam component while being inserted through said slotted opening;

said take up portion having a track for receiving a power cable; said let out portion having a track for receiving a power cable; the tracks for the take up portion and let out portion being substantially coplanar;

wherein the first end of said first power cable is attached to said take up terminating post and wrapped around said take up portion of said power cable cam component on said first cam assembly and the second end of said first power cable is attached to said let out terminating post and wrapped around the let out portion of said power cable cam component of said second cam assembly;

wherein the first end of said second power cable is attached to said let out terminating post and wrapped around said let out portion of said power cable cam component on said first cam assembly and the second end of said second power cable is attached to said take up terminating post and wrapped around the take up portion of said power cable cam component of said second cam assembly;

such that the tracks in said take up portion and let out portion of said power cable cam component of said first cam assembly are substantially coplanar.

16. The compound bow of claim 15 wherein the tracks on said take up portion and said let out portion of the power cable cam component of ether the first or second cam assembly are distinct, non-continuous tracks on the periphery of said power cable cam assembly.

17. The compound bow of claim 16 wherein said draw stop pin is attached to a let out portion of said power cable cam component of either said first or second cam assembly.

18. The compound bow of claim 15 wherein a location of said draw stop pin can be adjusted within said slotted opening.

19. The compound bow of claim 15 wherein said power cable cam component of said first cam assembly further comprises a modular unit that is sized and shaped to change draw parameters of said compound bow, and is designed to be interchanged with another modular let out portion being of a different size and shape to change said draw parameters of said compound bow.

20. The compound bow of claim 15 wherein said power cable cam component of said second cam assembly further comprises a modular unit that is sized and shaped to change draw parameters of said compound bow, and is designed to be interchanged with another modular let out portion being of a different size and shape to change said draw parameters of said compound bow.

* * * * *